US008426523B2

(12) United States Patent
Okabe

(10) Patent No.: US 8,426,523 B2
(45) **Date of Patent: *Apr. 23, 2013**

(54) GOLF BALL

(75) Inventor: Satoko Okabe, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 648 days.

This patent is subject to a terminal disclaimer.

(21) Appl. No.: 12/557,785

(22) Filed: Sep. 11, 2009

(65) Prior Publication Data

US 2010/0069177 A1 Mar. 18, 2010

(30) Foreign Application Priority Data

Sep. 16, 2008 (JP) ..... 2008-237038
Jun. 16, 2009 (JP) ..... 2009-143623
Aug. 24, 2009 (JP) ..... 2009-193331

(51) Int. Cl.
*A63B 37/12* (2006.01)
*A63B 37/00* (2006.01)
*C08L 33/02* (2006.01)

(52) U.S. Cl.
USPC ..... 525/221; 525/196; 525/201; 473/378; 473/385

(58) Field of Classification Search ..... None
See application file for complete search history.

(56) References Cited

U.S. PATENT DOCUMENTS

| | | | | |
|---|---|---|---|---|
| 3,819,768 | A | 6/1974 | Molitor | |
| 4,526,375 | A * | 7/1985 | Nakade | 473/385 |
| 5,292,794 | A | 3/1994 | Maginnis | |
| 5,298,571 | A | 3/1994 | Statz et al. | |
| 6,089,847 | A | 7/2000 | Inoue et al. | |
| 6,190,597 | B1 | 2/2001 | Inoue et al. | |
| 6,235,230 | B1 | 5/2001 | Puniello | |
| 6,238,194 | B1 | 5/2001 | Inoue et al. | |
| 6,838,501 | B2 | 1/2005 | Takesue et al. | |
| 6,962,951 | B1 | 11/2005 | Takesue et al. | |
| 7,211,610 | B2 | 5/2007 | Takesue et al. | |
| 2002/0037968 | A1 * | 3/2002 | Chen | 525/194 |
| 2002/0099120 | A1 | 7/2002 | Takesue et al. | |
| 2004/0132552 | A1 | 7/2004 | Chen | |
| 2005/0256269 | A1 | 11/2005 | Takesue et al. | |
| 2005/0261424 | A1 | 11/2005 | Snell et al. | |
| 2006/0014898 | A1 | 1/2006 | Kim | |
| 2006/0270491 | A1 * | 11/2006 | Jordan et al. | 473/371 |
| 2006/0293121 | A1 | 12/2006 | Egashira et al. | |
| 2008/0220904 | A1 | 9/2008 | Sullivan et al. | |
| 2008/0227569 | A1 | 9/2008 | Egashira et al. | |
| 2010/0069173 | A1 * | 3/2010 | Okabe et al. | 473/372 |
| 2010/0069177 | A1 | 3/2010 | Okabe | |
| 2010/0075777 | A1 * | 3/2010 | Shigemitsu et al. | 473/372 |
| 2010/0167846 | A1 * | 7/2010 | Hirau et al. | 473/378 |
| 2010/0298066 | A1 | 11/2010 | Kim | |

FOREIGN PATENT DOCUMENTS

| | | | |
|---|---|---|---|
| JP | 2-88087 | A | 3/1990 |
| JP | 9-313646 | A | 12/1997 |
| JP | 11-76466 | A | 3/1999 |
| JP | 11-151323 | A | 6/1999 |
| JP | 11-164914 | A | 6/1999 |
| JP | 2001-120686 | A | 5/2001 |
| JP | 2002-219195 | A | 8/2002 |
| JP | 2005-230212 | A | 9/2005 |
| JP | 3751824 | B2 | 12/2005 |
| JP | 2006-500995 | A | 1/2006 |
| JP | 2006-028517 | A | 2/2006 |
| JP | 2007-622 | A | 1/2007 |

OTHER PUBLICATIONS

Honeywell product literaure for ACLYN 295P: no date.*
Honeywell product literature for ACLYN 201A; no date.*
English translation of Notice of Reasons for Rejection issued Apr. 19, 2011, in Japanese Patent Application No. 2008-335603.
English translation of Notice of Reasons for Rejection issued Mar. 22, 2011, in Japanese Patent Application No. 2008-269361.
Office Action issued Apr. 9, 2012, in U.S. Appl. No. 12/560,190.
Office Action issued Aug. 22, 2012, in U.S. Appl. No. 12/560,190.
Office Action issued May 31, 2012, in U.S. Appl. No. 12/554,155.
Office Action issued Sep. 14, 2012, in U.S. Appl. No. 12/627,460.

* cited by examiner

*Primary Examiner* — David Buttner
(74) *Attorney, Agent, or Firm* — Birch, Stewart, Kolasch & Birch, LLP

(57) ABSTRACT

An object of the present invention is to provide a golf ball excellent in fluidity, adhesion of the paint film, and repulsion. Another object of the present invention is to provide a golf ball which is excellent in durability and low-temperature durability. The present invention provides a golf ball comprising: a core and a cover covering the core, wherein the cover is formed from a cover composition that contains as a resin component, (A) a specific high melt viscosity ionomer resin being neutralized with at least two metal ions, and (B) a low melt viscosity ionomer resin being neutralized with at least two metal ions, in a ratio of (A) the high melt viscosity ionomer resin/(B) the low melt viscosity ionomer resin being 55 mass % to 99 mass %/45 mass % to 1 mass %.

14 Claims, No Drawings

GOLF BALL

FIELD OF THE INVENTION

The present invention relates to a golf ball, in particular, relates to a technology for molding a cover and improving the cover property.

DESCRIPTION OF THE RELATED ART

Ionomer resins are used as a cover material for the golf ball, because of its excellent durability and repulsion performance. However, the heat stability and moldability are also necessary to prepare golf balls using ionomer resins. Further, the obtained golf balls are required to show the excellent shot feeling, controllability, repulsion performance and durability. From these aspects, various improvements have been proposed for golf balls using ionomer resins as a cover material.

For example, Japanese Patent Publication No. H02-88087 A discloses a golf ball which uses a dual-ion ionomer resin having its carboxyl groups neutralized with a sodium ion and copper ion. Japanese Patent Publication No. H09-313646 A discloses a golf ball material consisting of a mixture of an ionomer resin obtained by neutralizing an ethylene-(meth) acrylic acid copolymer with a magnesium ion and an ionomer resin obtained by neutralizing an ethylene-(meth)acrylic acid-(meth)acrylate copolymer with an alkali metal ion.

Japanese Patent Publication No. 2002-219195 A discloses a golf ball material that provides a high performance golf ball having an excellent repulsion as well as a good thermal stability, fluidity, and moldability. The golf ball material comprises a mixture which is composed of essential components:

100 parts by weight of a resinous component consisting of a base resin and (e) a non-ionomer thermoplastic elastomer, the base resin and the elastomer being blended in a weight ratio of 100:0 to 50:50;

(c) 5 to 80 parts by weight of a fatty acid and/or fatty acid derivative having a molecular weight of 280 to 1,500; and (d) 0.1 to 10 parts by weight of a basic inorganic metal compound capable of neutralizing acidic groups left unneutralized in the base resin and component (c), wherein the base resin has (a) an olefin-unsaturated carboxylic acid binary random copolymer and/or a metal ion-neutralized olefin-unsaturated carboxylic acid binary random copolymer, blended with (b) an olefin-unsaturated carboxylic acid-unsaturated carboxylate ternary random copolymer and/or a metal ion neutralized olefin-unsaturated carboxylic acid-unsaturated carboxylate ternary random copolymer, in a weight ratio of 100:0 to 25:75.

Japanese Patent Publication No. 2001-120686 A discloses a golf ball material containing a highly neutralized ionomer resin that provides a high performance golf ball having an excellent repulsion as well as good thermal stability, fluidity, and moldability. The golf ball material comprises a heated mixture having a melt index of 1.0 dg/min or more which is composed of:

100 parts by weight of (a) an olefin-unsaturated carboxylic acid random copolymer and/or an olefin-unsaturated carboxylic acid-unsaturated carboxylate random copolymer, (b) 5 to 80 parts by weight of a fatty acid or a derivative thereof having a molecular weight of 280 or more, and (c) 0.1 to 10 parts by weight of a basic inorganic metal compound capable of neutralizing acidic groups in components (a) and (b).

Japanese Patent Publication No. 2006-500995 T discloses a golf ball which has an improved softness and scuff resistance while maintaining the durability and flight distance.

The golf ball employs a blend of ionomer resins that have a different molecular weight each other, that is, a blend of a high molecular weight ternary ionomer resin (molecular weight about 80,000 to 500,000) and a low molecular weight binary ionomer resin (molecular weight about 2,000 to 30,000).

SUMMARY OF THE INVENTION

In order to enhance the repulsion of the golf ball, there is an approach of making the cover thin. However, the ionomer resin must have a high fluidity in order to make the thin cover. As a technology of improving the fluidity of the ionomer resin while maintaining the repulsion performance, it is known that a low molecular weight material such as a fatty acid is added to the ionomer resin having a high degree of neutralization. However, the addition of the low molecular weight material such as a fatty acid causes smoke generation during molding. Further, the low molecular weight material component tends to bleed out of a surface of the golf ball body. As a result, the adhesion of the paint film is lowered when applying a paint to the surface of the golf ball.

The present invention has been achieved in view of the above circumstances, and the object of the present invention is to provide a golf ball excellent in the fluidity, adhesion of the paint film, and repulsion performance. Another object of the present invention is to provide a golf ball which is excellent in the durability and low-temperature durability.

The present invention which has solved the above problems is directed to a golf ball comprising:

a core and a cover covering the core, wherein the cover is formed from a cover composition that contains as a resin component, (A) a high melt viscosity ionomer resin having a melt viscosity (190° C.) ranging from 500 Pa·s to 100,000 Pa·s measured by a flow tester and being neutralized with at least two metal ions, and (B) a low melt viscosity ionomer resin having a melt viscosity (190° C.) ranging from 1 Pa·s to 10 Pa·s measured by a brookfield viscometer and a melt flow rate (190° C.*2.16 kg) ranging from 100 g/10 min to 2,000 g/10 min, in a ratio of (A) the high melt viscosity ionomer resin/(B) the low melt viscosity ionomer resin being 55 mass % to 99 mass %/45 mass % to 1 mass %.

The present invention also provides a golf ball comprising:

a core and a cover covering the core, wherein the cover is formed from a cover composition that contains as a resin component, (A) a high melt viscosity ionomer resin having a melt viscosity (190° C.) ranging from 500 Pa·s to 100,000 Pa·s measured by a flow tester, being neutralized with at least two metal ions, and consisting of one prepared by neutralizing at least a part of carboxyl groups in a binary copolymer composed of ethylene and α,β-unsaturated carboxylic acid having 3 to 8 carbon atoms with a metal ion, one prepared by neutralizing at least a part of carboxyl groups in a ternary copolymer composed of ethylene, α,β-unsaturated carboxylic acid having 3 to 8 carbon atoms and α,β-unsaturated carboxylic acid ester with a metal ion, or a mixture thereof, and (B) a low melt viscosity ionomer resin having a melt viscosity (190° C.) ranging from 1 Pa·s to 10 Pa·s measured by a brookfield viscometer and a melt flow rate (190° C.*2.16 kg) ranging from 100 g/10 min to 2,000 g/10 min, and consisting of one prepared by neutralizing at least a part of carboxyl groups in a binary copolymer composed of ethylene and α,β-unsaturated carboxylic acid having 3 to 8 carbon atoms with a metal ion, one prepared by neutralizing at least a part of carboxyl groups in a ternary copolymer composed of ethylene, α,β-unsaturated carboxylic acid having 3 to 8 carbon atoms and α,β-unsaturated carboxylic acid ester with a metal ion, or a mixture thereof, in a ratio of (A) the high melt viscosity ionomer resin/(B) the low melt viscosity ionomer resin being 55 mass % to 99 mass %/45 mass % to 1 mass %.

In the present invention, since (A) the high melt viscosity ionomer resin component providing a high repulsion performance are blended as a main component with (B) the low melt viscosity ionomer resin which is a component for improving the fluidity and has a similar structure to (A) the high melt viscosity ionomer resin, the compatibility thereof is high. Thus, the bleed out of (B) the low melt viscosity ionomer resin from the surface of the golf ball body is suppressed. As a result, the golf balls excellent in the repulsion, fluidity, and the adhesion of the paint film are obtained. Further, the gist of the present invention resides in the point that the durability and the low-temperature durability of the obtained golf ball are remarkably improved by using the ionomer resin neutralized with at least two metal ions as (A) the high melt viscosity ionomer resin.

The present invention further provides a process for preparing a golf ball having a core and a cover covering the core, comprising the steps of mixing (A) a high melt viscosity ionomer resin having a melt viscosity (190° C.) ranging from 500 Pa·s to 100,000 Pa·s measured by a flow tester, being neutralized with at least two metal ions and consisting of one prepared by neutralizing at least a part of carboxyl groups in a binary copolymer composed of ethylene and α,β-unsaturated carboxylic acid having 3 to 8 carbon atoms with a metal ion, one prepared by neutralizing at least a part of carboxyl groups in a ternary copolymer composed of ethylene, α,β-unsaturated carboxylic acid having 3 to 8 carbon atoms and α,β-unsaturated carboxylic acid ester with a metal ion, or a mixture thereof, and (B) a low melt viscosity ionomer resin having a melt viscosity (190° C.) ranging from 1 Pa·s to 10 Pa·s measured by a brookfield viscometer and a melt flow rate (190° C.*2.16 kg) ranging from 100 g/10 min to 2,000 g/10 min, and consisting of one prepared by neutralizing at least a part of carboxyl groups in a binary copolymer composed of ethylene and α,β-unsaturated carboxylic acid having 3 to 8 carbon atoms with a metal ion, one prepared by neutralizing at least a part of carboxyl groups in a ternary copolymer composed of ethylene, α,β-unsaturated carboxylic acid having 3 to 8 carbon atoms and α,β-unsaturated carboxylic acid ester with a metal ion, or a mixture thereof, in a ratio of (A) the high melt viscosity ionomer resin/(B) the low melt viscosity ionomer resin being 55 mass % to 99 mass % 45 mass % to 1 mass % to prepare a cover composition; and forming the cover from the cover composition.

The present invention provides the golf ball excellent in the fluidity, the adhesion of the paint film, and the repulsion performance. Further, the present invention provides the golf ball excellent in the durability and low-temperature durability.

DESCRIPTION OF THE PREFERRED EMBODIMENT

The present invention provides a golf ball comprising:

a core and a cover covering the core, wherein the cover is formed from a cover composition that contains as a resin component, (A) a high melt viscosity ionomer resin having a melt viscosity (190° C.) ranging from 500 Pa·s to 100,000 Pa·s measured by a flow tester, being neutralized with at least two metal ions, and (B) a low melt viscosity ionomer resin having a melt viscosity (190° C.) ranging from 1 Pa·s to 10 Pa·s measured by a brookfield viscometer and a melt flow rate (190° C.*2.16 kg) ranging from 100 g/10 min to 2,000 g/10 min, in a ratio of (A) the high melt viscosity ionomer resin/(B) the low melt viscosity ionomer resin being 55 mass % to 99 mass %/45 mass % to 1 mass %.

First, "(A) the high melt viscosity ionomer resin" contained in the cover composition will be explained.

(A) The high melt viscosity ionomer resin is neutralized with at least two meal ions and preferably contains one prepared by neutralizing at least a part of carboxyl groups in a binary copolymer composed of ethylene and α,β-unsaturated carboxylic acid having 3 to 8 carbon atoms with a metal ion, one prepared by neutralizing at least a part of carboxyl groups in a ternary copolymer composed of ethylene, α,β-unsaturated carboxylic acid having 3 to 8 carbon atoms, and α,β-unsaturated carboxylic acid ester with a metal ion, or a mixture thereof.

As (A) the high melt viscosity ionomer resin, the mixture of the two kinds of the copolymers (ionomer resins), each being neutralized with a different metal ion from other, may be used. However, it is more preferable to use the ionomer resin which is obtained by neutralizing at least a part of carboxyl groups existing in one kind of the copolymer molecular chain with at least two metal ions (hereinafter, the one neutralized with two kinds of metal ions is referred to as "dual ion ionomer resin.") The use of the dual ion ionomer resin enhances the stiffness of the cover composition and thus the repulsive resilience becomes high.

Examples of the metal ion include: monovalent alkali metal ions such as sodium, potassium, lithium, and the like; divalent metal ions such as magnesium, calcium, zinc, barium, cadmium, and the like; trivalent metal ions such as aluminum and the like; and other metal ions such as tin, zirconium, and the like. Among them, (A) the high melt viscosity ionomer resin is preferably neutralized with the monovalent metal ion of sodium ion and/or lithium ion and the divalent metal ion of zinc ion and/or magnesium ion. If the metal ion contains both the monovalent metal ion and the divalent metal ion, the stiffness of the cover composition is enhanced and thus the repulsive resilience gets higher.

The degree of neutralization of (A) the high melt viscosity ionomer resin with the monovalent metal ion consisting of sodium ion and/or lithium ion is preferably 10 mole % or more, more preferably 15 mole % or more, even more preferably 20 mole % or more, and is preferably 60 mole % or less, more preferably 55 mole % or less, even more preferably 50 mole % or less. Adjusting the degree of the neutralization of (A) the high melt viscosity ionomer resin with the monovalent metal ion within the above range improves the balances of the fluidity, slab hardness, stiffness, and repulsive resilience of the cover composition.

The degree of neutralization of (A) the high melt viscosity ionomer resin with the monovalent metal ion can be calculated by using the following mathematical expression.

Degree of neutralization (mole %) of (A) the high melt viscosity ionomer resin=(the number of moles of carboxyl groups neutralized with the monovalent metal ion of the high melt viscosity ionomer resin/the number of moles of all carboxyl groups contained in the high melt viscosity ionomer resin)×100

The content ratio (M1/M2, mole ratio) of (M1) the monovalent metal ion consisting of the sodium ion and/or lithium ion to (M2) the divalent metal ion consisting of the zinc ion and/or magnesium ion in (A) the high melt viscosity ionomer resin is preferably 0.1 or more, more preferably 0.2 or more, even more preferably 0.3 or more, and is preferably 60 or less, more preferably 50 or less, even more preferably 40 or less. Adjusting the molar ratio of the monovalent metal ion and the divalent metal ion contained in (A) the high melt viscosity ionomer resin within the above range improves the balances of the fluidity, slab hardness, stiffness, and repulsive resilience of the cover composition.

The ionomer resin that has the neutralization degree with the monovalent metal ion consisting of the sodium ion and/or lithium ion from 10 mole % to 60 mole % and the content ratio (M1/M2) of the monovalent metal ion to the divalent metal ion from 0.1 to 60 is preferably obtained by providing the ionomer resin having the neutralization degree with the monovalent metal ion consisting of the sodium ion and/or lithium ion from 10 mole % to 60 mole % as a starting material, and mixing the ionomer resin with basic zinc carbonate, zinc acetate, zinc oxide, or magnesium hydrate under a melting condition.

Examples of the α,β-unsaturated carboxylic acid having 3 to 8 carbon atoms that constitute (A) the high melt viscosity ionomer resin are; acrylic acid, methacrylic acid, fumaric acid, maleic acid and crotonic acid. Among these, acrylic acid and methacrylic acid are particularly preferred. Examples of the α,β-unsaturated carboxylic acid ester include methyl ester, ethyl ester, propyl ester, n-butyl ester, isobutyl ester of acrylic acid, methacrylic acid, fumaric acid, and maleic acid. In particular, acrylic acid ester and methacrylic acid ester are preferable.

Among them, (A) the high melt viscosity ionomer resin preferably includes one prepared by neutralizing at least a part of carboxyl groups of the binary copolymer composed of ethylene and α,β-unsaturated carboxylic acid having 3 to 8 carbon atoms with at least two metal ions, one prepared by neutralizing at least a part of carboxyl groups of the ternary copolymer composed of ethylene, α,β-unsaturated carboxylic acid having 3 to 8 carbon atoms, α,β-unsaturated carboxylic acid ester with at least two metal ions, or a mixture thereof, and more preferably includes one prepared by neutralizing at least a part of carboxyl groups of the binary copolymer composed of ethylene and (meth)acrylic acid with at least two metal ions, one prepared by neutralizing at least a part of carboxyl groups of the ternary copolymer composed of ethylene, (meth)acrylic acid, (meth)acrylic acid ester with at least two metal ions, or a mixture thereof.

In the above explanation, the term of "(meth)acrylic acid" means acrylic acid or methacrylic acid.

The content of α,β-unsaturated carboxylic acid having 3 to 8 carbon atoms in (A) the high melt viscosity ionomer resin is preferably 2 mass % or more, more preferably 3 mass % or more, and is preferably 30 mass % or less, more preferably 25 mass % or less.

The melt viscosity (190° C.) of (A) the high melt viscosity ionomer resin measured by a flow tester is 500 Pa·s or more, preferably 1,000 Pa·s or more, more preferably 1,500 Pa·s or more and is 100,000 Pa·s or less, preferably 95,000 Pa·s or less, more preferably 92,000 Pa·s or less. If the melt viscosity is 500 Pa·s or more, the durability of the resultant golf ball is improved, and while if the melt viscosity is 100,000 Pa·s or less, the moldability of the cover composition is improved.

Next, "(B) the low melt viscosity ionomer resin" used in the present invention will be explained.

(B) The low melt viscosity ionomer resin preferably includes one prepared by neutralizing at least a part of carboxyl groups of the binary copolymer composed of ethylene and α,β-unsaturated carboxylic acid having 3 to 8 carbon atoms with a metal ion, one prepared by neutralizing at least a part of carboxyl groups of the ternary copolymer composed of ethylene, α,β-unsaturated carboxylic acid having 3 to 8 carbon atoms, α,β-unsaturated carboxylic acid ester with a metal ion, or a mixture thereof. As the α,β-unsaturated carboxylic acid having 3 to 8 carbon atoms, the same as examples constituting "(A) the high melt viscosity ionomer resin" can be used.

Examples of a metal ion used to neutralize a part of carboxyl group of the binary copolymer composed of ethylene and α,β-unsaturated carboxylic acid having 3 to 8 carbon atoms, and the ternary copolymer composed of ethylene, α,β-unsaturated carboxylic acid having 3 to 8 carbon atoms, α,β-unsaturated carboxylic acid ester include: monovalent metal ions such as sodium, potassium, lithium, and the like; divalent metal ions such as magnesium, calcium, zinc, barium, cadmium, and the like; trivalent metal ions such as aluminum and the like; and other metal ions such as tin, zirconium, and the like. These meta ions may be used solely or in combination of two or more thereof. Among these metal ions, (B) the low melt viscosity ionomer resin is preferably neutralized with the divalent metal ion such as magnesium, calcium, zinc, barium, cadmium, and the like.

The melt viscosity (190° C.) of (B) the low melt viscosity ionomer resin measured by a brookfield viscometer is preferably 1 Pa·s or more, more preferably 2 Pa·s or more, even more preferably 3 Pa·s or more, and is preferably 10 Pa·s or less, more preferably 9 Pa·s or less, even more preferably 8 Pa·s or less. If the melt viscosity of (B) the low melt viscosity ionomer resin is 1 Pa·s or more, the compatibility with (A) component becomes high and thus the durability of the resultant golf ball improves. While if the melt viscosity of (B) the low melt viscosity ionomer resin is 10 Pa·s or less, the improving effect of the fluidity of the cover composition becomes large.

The melt flow rate (190° C., 2.16 kg) of (B) the low melt viscosity ionomer resin is preferably 100 g/10 min or more, more preferably 150 g/10 min or more, and even more preferably 200 g/10 min or more, and is preferably 2,000 g/10 min or less, more preferably 1,900 g/10 min or less, and even more preferably 1,800 g/10 min or less. If the melt flow rate of (B) the low melt viscosity ionomer resin is 100 g/10 min or more, the improved effect of the fluidity of the cover composition is large, while if the melt flow rate is 2,000 g/10 min or less, the compatibility with (A) component becomes high and the durability of the resultant golf ball improves.

The content of α,β-unsaturated carboxylic acid having 3 to 8 carbon atoms in (B) the low melt viscosity ionomer resin is preferably 2 mass % or more, more preferably 3 mass % or more, and is preferably 30 mass % or less, more preferably 20 mass % or less.

The degree of neutralization of the carboxyl groups of (B) the low melt viscosity ionomer resin is preferably 10 mole % or more, more preferably 15 mole % or more, even more preferably 20 mole % or more, and even more preferably 100 mole %.

The degree of neutralization of the carboxyl groups of (B) the low melt viscosity ionomer resin can be calculated by using the following mathematical expression.

Degree of neutralization (mol %) of (*B*) the low melt viscosity ionomer resin=(the number of moles of carboxyl groups neutralized of the low melt viscosity ionomer resin/the total number of moles of carboxyl groups contained in the low melt viscosity ionomer resin)×100

Specific examples of (B) the low melt viscosity ionomer resin are "Aclyn (registered trade name) 201 (Ca)," "Aclyn246 (Mg)," and "Aclyn295 (Zn)" available from Honeywell Inc.

The blending ratio of (A) the high melt viscosity ionomer resin/(B) the low melt viscosity ionomer resin contained in the cover composition is preferably 55 mass % to 99 mass %/45 mass % to 1 mass %. If the blending ratio falls within the above range, since the fluidity of the cover composition improves, it is possible to produce the thin cover. As a result, the repulsion and the durability of the resultant golf ball are improved. The blending ratio of (A) the high melt viscosity ionomer resin/(B) the low melt viscosity ionomer resin is preferably 58 mass % to 90 mass %/42 mass % to 10 mass %, more preferably 60 mass % to 85 mass %/40 mass % to 15 mass %.

The content of the divalent metal per 100 g of the resin component constituting the cover composition is preferably 0.015 mole or more, more preferably 0.025 mole or more, even more preferably 0.03 mole or more, even more preferably 0.033 mole or more. If the content of the divalent metal per 100 g of the resin component is 0.015 mole or more, the durability, especially the low-temperature durability is improved. The upper limit of the content of the divalent metal per 100 g of the resin component is preferably, but not limited to, 0.16 mole, more preferably 0.15 mole, even more preferably 0.12 mole. If the content of the divalent metal per 100 g of the resin component is too much, the fluidity of the cover composition and the repulsion of the resultant golf ball may be lowered.

Examples of the divalent metal ions are Ca, Mg, and Zn. Among them, Zn is preferable. The use of Zn as the divalent metal ion improves the durability, especially the low-temperature durability.

The content of the divalent metal ion neutralizing the carboxyl groups means a total content of the divalent metal ion neutralizing the carboxyl groups of (A) the high melt viscosity ionomer resin and the divalent metal ion neutralizing the carboxyl groups of (B) the low melt viscosity ionomer resin, and is determined by the method later described.

In a preferable embodiment of the present invention, the resin component of the cover composition for the golf ball essentially consists of (A) the high melt viscosity ionomer resin and (B) the low melt viscosity ionomer resin. However, in another preferable embodiment, the cover composition may further contain (C) a nonionic thermoplastic resin having a melt viscosity measured by a flow tester ranging from 5 Pa·s to 3,000 Pa·s in addition to (A) the high melt viscosity ionomer resin and (B) the low melt viscosity ionomer resin. Herein, the term "nonionic" means that there is no ionic center where an acid component (preferably, carboxyl group) is neutralized.

In this case, the resin component preferably comprises each component in the content of (A) the high melt viscosity ionomer resin: 50 mass % to 90 mass %, (B) the low melt viscosity ionomer resin: 5 mass % to 20 mass %, and (C) the nonionic thermoplastic resin: 5 mass % to 30 mass %, more preferably in the content of (A) the high melt viscosity ionomer resin: 55 mass % to 85 mass %, (B) the low melt viscosity ionomer resin: 6 mass % to 18 mass %, and (C) the nonionic thermoplastic resin: 6 mass % to 27 mass %.

Examples of (C) the nonionic thermoplastic resin that can be contained in the cover composition for the golf ball of the present invention are a thermoplastic polyamide elastomer having a commercial name of "Pebax (registered trademark) (e.g. "Pebax 2533")" commercially available from Arkema K. K.; an ethylene-methacrylic acid copolymer having a commercial name of "NUCREL (registered trademark) (e.g. NUCREL N1050H, NUCREL N2050H, NUCREL N1110H, NUCREL NO200H) or an ethylene-acrylic acid copolymer having a commercial name of "PRIMACOR (registered trademark)" 59901" available from Du Pont-Mitsui Polychemicals Co., Ltd.; a thermoplastic polyester elastomer having a commercial name of "Hytrel (registered trademark) (e.g. "Hytrel 3548", "Hytrel 4047")" commercially available from Du Pont-Toray Co., Ltd.; a thermoplastic polystyrene elastomer having a commercial name of "Rabalon (registered trademark)" and a thermoplastic polyester elastomer having a commercial name of "Primalloy (registered trademark) (e.g. "Primalloy A1500"," commercially available from Mitsubishi Chemical Corporation; a polyurethane elastomer having a commercial name of "Elastollan (registered trademark) (e.g. "Elastollan ET880")" commercially available from BASF Japan Ltd.

The melt viscosity (190° C.) of (C) the nonionic thermoplastic resin measured by a flow tester is preferably 5 Pa·s or more, more preferably 10 Pa·s or more, even more preferably 15 Pa·s or more, and is preferably 3,000 Pa·s or less, more preferably 2,800 Pa·s or less, even more preferably 2,500 Pa·s or less. If the melt viscosity (190° C.) of (C) the nonionic thermoplastic resin is 5 Pa·s or more, the durability of the resultant golf ball improves, while if the melt viscosity is 3,000 Pa·s or less, the moldability of the cover composition improves.

In the present invention, in addition to the aforementioned resin component, the cover composition may further contain a pigment component such as a white pigment (titanium oxide), a blue pigment, a red pigment, and the like, a specific gravity adjusting agent such as zinc oxide, calcium carbonate, barium sulfate, and the like, a dispersant, an antioxidant, an ultraviolet absorber, a light stabilizer, a fluorescent material or a fluorescent brightener and the like, as long as they do not impair the performance of the cover.

The amount of the white pigment (titanium oxide), with respect to 100 parts by mass of the resin component constituting the cover, is preferably 0.5 part by mass or more, more preferably 1 part by mass or more, and is preferably 10 parts by mass or less, more preferably 8 parts by mass or less. By causing the amount of the white pigment to be 0.5 parts by mass or more, it is possible to impart the opacity to the cover. If the amount of the white pigment is more than 10 parts by mass, there is the possibility that the durability of the resultant cover will deteriorate.

In the present invention, the melt flow rate (190° C., 2.16 kg) of the cover composition is preferably 10 g/10 min or more, more preferably 15 g/10 min or more, and even more preferably 20 g/10 min or more, and is preferably 100 g/10 min or less, more preferably 95 g/10 min or less, and even more preferably 90 g/10 min or less. If the melt flow rate of the cover composition is 10 g/10 min or more, the moldability of the cover composition is enhanced.

The cover composition preferably has a bending stiffness of 100 MPa or more, more preferably 110 MPa or more, even more preferably 120 MPa or more, and preferably has a bending stiffness of 450 MPa or less, more preferably 420 MPa or less, even more preferably 400 MPa or less. If the bending stiffness of the cover composition is 100 MPa or more, since the obtained golf ball has an outer-hard inner soft structure, the flight distance becomes great. On the other hand, if the bending stiffness is 450 MPa or less, the cover becomes appropriately soft and thus the shot feeling of the golf ball becomes good.

The cover composition preferably has a repulsive resilience of 40% or more, more preferably 41% or more, even more preferably 42% or more. If the repulsive resilience of the cover composition is 40% or more, the flight distance of the obtained golf ball becomes large. Herein, the bending stiffness and the repulsive resilience of the cover composition are measured by forming the cover composition into a sheet form. The method for the measurement is described later.

The cover composition preferably has a slab hardness of 40 or more, more preferably 45 or more, even more preferably 50 or more, and preferably has a slab hardness of 70 or less, more preferably 68 or less, even more preferably 65 or less in Shore n hardness. If the cover composition has slab hardness of 40 or more, the stiffness of the resultant cover is enhanced, and thus the golf ball excellent in the repulsion (flight distance) is obtained. On the other hand, if the cover composition has a slab hardness of 70 or less, the durability is more enhanced. Herein, the slab hardness of the cover composition is a measured hardness of the cover composition that is molded into a sheet form by a measuring method described later.

In the present invention, the thickness of the cover of the golf ball is preferably 3 mm or less, more preferably 2.5 mm or less, and even more preferably 2 mm or less, even more preferably 1.5 mm or less. This is because by causing the thickness of the cover to be 3 mm or less, the desirable repulsion and shot feeling are obtained. The thickness of the cover is preferably 0.1 mm or more, more preferably 0.2 mm or more, and even more preferably 0.3 mm or more. This is because if the thickness of the cover is less than 0.1 mm, it may become difficult to mold the cover. In addition, the durability and the abrasion resistance of the cover may deteriorate.

After the cover is molded, the mold is opened and the golf ball body is taken out from the mold, and as necessary, the golf ball body is preferably subjected to surface treatments such as deburring, cleaning, and sandblast. If desired, a paint film or a mark may be formed.

Next, the preferable core of the golf ball of the present invention is explained. The core of the golf ball of the present invention includes, for example, a single-layered core, a core consisting of a center and a single-layered intermediate layer covering the center, a core consisting of a center and multi-piece or multi-layer of intermediate layers covering the center. The core preferably has a spherical shape. If the core does not have a spherical shape, the cover does not have a uniform thickness. As a result, there exist some portions where the performance of the cover is lowered. On the other hand, the center generally has the spherical shape, but the center may be provided with a rib on the surface thereof so that the surface of the spherical center is divided by the ribs. For example, the surface of the spherical center is evenly divided by the ribs. In one embodiment, the ribs are preferably formed on the surface of the spherical center in an integrated manner, and in another embodiment, the ribs are formed as an intermediate layer on the surface of the spherical center.

The ribs are preferably formed along an equatorial line and meridians that evenly divide the surface of the spherical center, if the spherical center is assumed as the earth. For example, if the surface of the spherical center is evenly divided into 8, the ribs are formed along the equatorial line, any meridian as a standard, and meridians at the longitude 90 degrees east, longitude 90 degrees west, and the longitude 180 degrees east (west), assuming that the meridian as the standard is at longitude 0 degree. If the ribs are formed, the depressed portion divided by the ribs are preferably filled with a plurality of intermediate layers or with a single-layered intermediate layer that fills each of the depressed portions to make a core in the spherical shape. The shape of the ribs, without limitation, includes an arc or an almost arc (for example, a part of the arc is removed to obtain a flat surface at the cross or orthogonal portions thereof).

As the center or the core of the golf ball of the present invention, a conventionally known rubber composition (hereinafter simply referred to as "core rubber composition" occasionally) may be employed, and it can be molded by, for example, heat-pressing a rubber composition containing a base rubber, a crosslinking initiator, a co-crosslinking agent, and a filler.

As the base rubber, a natural rubber and/or a synthetic rubber may be used. Examples of the base rubber are a polybutadiene rubber, a natural rubber, a polyisoprene rubber, a styrene polybutadiene rubber, and ethylene-propylene-diene terpolymer (EPDM). Among them, typically preferred is the high cis-polybutadiene having cis-1,4-bond in a proportion of 40% or more, more preferably 70% or more, even more preferably 90% or more in view of its superior repulsion property.

The crosslinking initiator is blended to crosslink the base rubber component. As the crosslinking initiator, an organic peroxide is preferably used. Examples of the organic peroxide for use in the present invention are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. An amount of the crosslinking initiator to be blended in the rubber composition is preferably 0.2 part by mass or more, more preferably 0.3 part by mass or more, and is preferably 3 parts by mass or less, more preferably 2 parts by mass or less based on 100 parts by mass of the base rubber. If the amount is less than 0.2 part by mass, the core becomes too soft, and the repulsion tends to be lowered, and if the amount is more than 3 parts by mass, the amount of the co-crosslinking agent must be increased in order to obtain the appropriate hardness, which tends to cause the insufficient repulsion.

The co-crosslinking agent is not particularly limited as long as it serves to crosslink a rubber molecule by graft polymerization with a base rubber molecular chain; for example, α,β-unsaturated carboxylic acid having 3 to 8 carbon atoms or a metal salt thereof, more preferably acrylic acid, methacrylic acid or a metal salt thereof may be used. As the metal constituting the metal salt, for example, zinc, magnesium, calcium, aluminum and sodium may be used, and among them, zinc is preferred because it provides high repulsion. The amount of the co-crosslinking agent to be used is preferably 10 parts or more, more preferably 20 parts or more, and is preferably 50 parts or less, more preferably 40 parts or less, based on 100 parts of the base rubber by mass. If the amount of the co-crosslinking agent to be used is less than 10 parts by mass, the amount of the crosslinking initiator must be increased to obtain an appropriate hardness, which tends to lower the repulsion. On the other hand, if the amount of the co-crosslinking agent to be used is more than 50 parts by mass, the core becomes too hard, so that the shot feeling may be lowered.

The filler contained in the core rubber composition is mainly blended as a specific gravity adjusting agent in order to adjust the specific gravity of the golf ball obtained as the final product in the range of 1.0 to 1.5, and may be blended as required. Examples of the filler include an inorganic filler such as zinc oxide, barium sulfate, calcium carbonate, magnesium oxide, tungsten powder, and molybdenum powder. The amount of the filler to be blended in the rubber composition is preferably 2 parts or more, more preferably 3 parts or more, and preferably 50 parts or less, more preferably 35 parts or less based on 100 parts of the base rubber by mass. If the amount of the filler to be blended is less than 2 parts by mass, it becomes difficult to adjust the weight, while if it is more than 50 parts by mass, the weight ratio of the rubber component becomes small and the repulsion tends to be lowered.

As the core rubber composition, an organic sulfur compound, an antioxidant or a peptizing agent may be blended appropriately in addition to the base rubber, the crosslinking initiator, the co-crosslinking agent and the filler.

As the organic sulfur compound, a diphenyl disulfide or a derivative thereof may be preferably used. Examples of the diphenyl disulfide or the derivative thereof include diphenyl disulfide, a mono-substituted diphenyl disulfide such as bis (4-chlorophenyl) disulfide, bis(3-chlorophenyl)disulfide, bis (4-bromophenyl) disulfide, bis(3-bromophenyl)disulfide, bis (4-fluorophenyl)disulfide, bis(4-iodophenyl)disulfide and bis (4-cyanophenyl)disulfide; a di-substituted diphenyl disulfide such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, and bis(2-cyano-5-bromophenyl)disulfide; a tri-substituted diphenyl disulfide such as bis(2,4,6-trichlorophenyl)disulfide, and bis (2-cyano-4-chloro-6-bromophenyl)disulfide; a tetra-substituted diphenyl disulfide such as bis(2,3,5,6-tetra chlorophenyl)disulfide; a penta-substituted diphenyl disulfide such as bis(2,3,4,5,6-pentachlorophenyl)disulfide and bis(2,3,4,5,6-pentabromophenyl)disulfide. These diphenyl disulfides or the derivative thereof can enhance resilience by having some influence on the state of vulcanization of vulcanized rubber. Among them, diphenyl disulfide and bis(pentabromophenyl) disulfide are preferably used since a golf ball having particularly high resilience can be obtained. The amount of the diphenyl disulfide or the derivative thereof to be blended is preferably 0.1 part by mass or more, more preferably 0.3 part by mass or more, and preferably 5.0 parts by mass or less, more preferably 3.0 parts by mass or less relative to 100 parts by mass of the base rubber.

The amount of the antioxidant to be blended is preferably 0.1 part or more and is preferably 1 part or less based on 100 parts of the base rubber by mass. Further, the amount of the peptizing agent is preferably 0.1 part or more and is preferably 5 parts or less based on 100 parts of the base rubber by mass.

The conditions for press-molding the core rubber composition should be determined appropriately depending on the rubber composition. The press-molding is preferably carried out for 10 to 60 minutes at the temperature of 130° C. to 200° C. Alternatively, the press-molding is preferably carried out in a two-step heating, for example, for 20 to 40 minutes at the temperature of 130° C. to 150° C., and continuously for 5 to 15 minutes at the temperature of 160° C. to 180° C.

The diameter of the core of the golf ball of the present invention is preferably 39.0 mm or more, more preferably 39.5 mm or more, and even more preferably 40.8 mm or more. If the diameter of the core is less than 39.0 mm, the cover becomes excessively thick and hence the repulsion of the golf ball may deteriorate. Further, the diameter of the core is preferably 42.2 mm or less, more preferably 42.0 mm or less, and even more preferably 41.8 mm or less. If the diameter of the core is more than 42.2 mm, the thickness of the cover becomes relatively thin, and hence a protection effect of the cover is not obtained sufficiently.

A compression deformation amount (shrinking deformation amount of the core along the compression direction) of the core when applying a load from 98 N as an initial load to 1275 N as a final load is preferably 2.50 mm or more, more preferably 2.60 mm or more, even more preferably 2.70 mm or more, and is preferably 3.20 mm or less, more preferably 3.10 mm or less, even more preferably 3.00 mm or less. If the compression deformation amount is less than 2.50 mm, the core becomes too hard, resulting in the poor shot feeling, while if the compression deformation amount is more than 3.20 mm, the core becomes too soft, resulting in the heavy shot feeling.

It is preferable that the core of the present invention has a larger surface hardness than the center hardness. For example, if the core consists of multiple layers, it is easy to make the surface hardness larger than the center hardness. The hardness difference between the surface hardness and the center hardness of the core in the golf ball of the present invention is preferably 4 or larger, more preferably 8 or larger in Shore D hardness. Making the surface hardness of the core larger than the center hardness increases the launch angle and decreases the amount of spin, thereby improving the flight distance of the golf ball. The upper limit of the hardness difference between the surface hardness and the center hardness of the core is, without limitation, preferably 24, more preferably 20 in Shore D. If the hardness difference is too large, the durability of the golf ball tends to be lower.

The center hardness of the core is preferably 30 or larger, more preferably 32 or larger, and even more preferably 35 or larger in Shore D hardness. If the center hardness is smaller than 30 in Shore D hardness, the core becomes so soft that the resilience of the golf ball tends to be lower. The center hardness of the core is preferably 50 or smaller, more preferably 48 or smaller, and even more preferably 45 or smaller in Shore D. If the center hardness is larger than 50 in Shore D hardness, the core becomes so hard that the shot feeling deteriorates. In the present invention, the center hardness of the core is the hardness measured with the Shore D type spring hardness tester at the central point of a cut plane of a core which has been cut into two halves.

The surface hardness of the core is preferably 45 or larger, more preferably 50 or larger, and even more preferably 55 or larger in Shore D hardness. If the surface hardness is smaller than 45, the core becomes so soft and the resilience may be lowered. The surface hardness of the core is preferably 65 or smaller, more preferably 62 or smaller, and even more preferably 60 or smaller in shore D hardness. If the surface hardness is larger than 65 in Shore D hardness, the core becomes so hard that the shot feeling may deteriorate.

In the case that the core consists of a center and a single layered intermediate layer covering the center, or that the core consists of a center and multi-piece of intermediate layers or multi-layer of intermediate layers covering the center, a material for the intermediate layer includes, for example, a thermoplastic resin such as a polyurethane resin, ionomer resin, nylon, and polyethylene, and a thermoplastic elastomer such as a polystyrene elastomer, polyolefin elastomer, polyurethane elastomer, polyester elastomer. Among them, the ionomer resin is preferable.

The intermediate layer of the golf ball of the present invention may contain a specific gravity adjusting agent such as barium sulfate and tungsten, an anti-oxidant, and a pigment in addition to the above resin component.

The golf ball of the present invention is not particularly limited on a structure thereof as long as the golf ball has a core and a cover. Examples of the golf ball of the present invention include a two-piece golf ball comprising a single-layered core, and a cover covering the core; a three-piece golf ball comprising a core consisting of a center and an intermediate layer covering the center, and a cover covering the core; a multi-piece golf ball comprising a core consisting of a center and a multi-piece or multi-layer of intermediate layers covering the center, and a cover covering the core; and a wound golf ball comprising a wound core, and a cover covering the wound core. The present invention can be suitably applied to anyone of the above golf ball.

When preparing a wound golf ball in the present invention, a wound core may be used as the core. In that case, for example, a wound core comprising a center formed by curing the above core rubber composition and a rubber thread layer which is formed by winding a rubber thread around the center in an elongated state can be used. In the present invention, the rubber thread, which is conventionally used for winding around the center, can be adopted for winding around the center. The rubber thread, for example, is obtained by vulcanizing a rubber composition including a natural rubber, or a mixture of a natural rubber and a synthetic polyisoprene, a sulfur, a vulcanization auxiliary agent, a vulcanization accelerator, and an antioxidant. The rubber thread is wound around the center in elongation of about 10 times length to form the wound core.

When the golf ball of the present invention has a diameter in a range from 40 mm to 45 mm, a compression deformation amount of the golf ball (an amount of compression of the golf ball in the compression direction thereof) when applying an initial load of 98 N to a final load of 1275 N to the golf ball is preferably 2.0 mm or more, more preferably 2.2 mm or more, and is preferably 4.0 mm or less, more preferably 3.5 mm or less. By causing the compression deformation amount to be 2.0 mm or more, the golf ball does not become too hard and the desirable shot feeling is obtained. By causing the compression deformation amount to be 4.0 mm or less, the repulsion is enhanced.

The present invention may further include a coated golf ball that comprising a golf ball body consisting of a core and a cover covering the core and a paint film covering the golf ball body.

The resin component constituting the paint film includes, without limitation, an acrylic resin, an epoxy resin, a polyurethane resin, a polyester resin, a cellulose resin. Among them, the two part curing type polyurethane resin described later is preferably used. The use of the two part curing type polyurethane resin provides a paint film with a more excellent durability.

The two part curing type polyurethane resin is a polyurethane resin that is cured by reacting a base material and a curing agent. For example, the two part curing type polyurethane resin is obtained by curing the base material containing a polyol component with a polyisocyanate compound or a derivative thereof. The base material containing the polyol component preferably contains a urethane polyol, which is obtained by reacting the polyisocyanate compound with the polyol.

The paint film preferably has a thickness of, but not limited to, 5 μm or larger, and more preferably 7 μm or larger, and preferably has a thickness of 25 μm or smaller, and more preferably 18 μm or smaller. This is because if the thickness is smaller than 5 μm, the paint film is easy to wear off due to continued use of the golf ball, and if the thickness is larger than 25 μm, the effect of the dimples is reduced, resulting in the low flying performance of the golf ball.

Next, the method for preparing the golf ball of the present invention will be explained.

The present invention also provides a method for preparing a golf ball having a core and a cover covering the core, comprising the steps of mixing (A) a high melt viscosity ionomer resin having a melt viscosity (190° C.) ranging from 500 Pa·s to 100,000 Pa·s measured by a flow tester, being neutralized with at least two metal ions, and consisting of one prepared by neutralizing at least a part of carboxyl groups in a binary copolymer composed of ethylene and α,β-unsaturated carboxylic acid having 3 to 8 carbon atoms with a metal ion, one prepared by neutralizing at least a part of carboxyl groups in a ternary copolymer composed of ethylene, α,β-unsaturated carboxylic acid having 3 to 8 carbon atoms and α,β-unsaturated carboxylic acid ester with a metal ion, or a mixture thereof, and (B) a low melt viscosity ionomer resin having a melt viscosity (190° C.) ranging from 1 Pa·s to 10 Pa·s measured by a brookfield viscometer and a melt flow rate (190° C.*2.16 kg) ranging from 100 g/10 min to 2,000 g/10 min, and consisting of one prepared by neutralizing at least a part of carboxyl groups in a binary copolymer composed of ethylene and α,β-unsaturated carboxylic acid having 3 to 8 carbon atoms with a metal ion, one prepared by neutralizing at least a part of carboxyl groups in a ternary copolymer composed of ethylene, α,β-unsaturated carboxylic acid having 3 to 8 carbon atoms and α,β-unsaturated carboxylic acid ester with a metal ion, or a mixture thereof, in a ratio of (A) the high melt viscosity ionomer resin/(B) the low melt viscosity ionomer resin being 55 mass % to 99 mass %/45 mass % to 1 mass % to prepare a cover composition; and forming the cover from the cover composition.

A method for preparing the cover composition in the step of preparing the cover composition includes, for example, an embodiment (I) where (A) the high melt viscosity ionomer resin and (B) the low melt viscosity ionomer resin are melt-mixed, and then the obtained mixture and the additives for the cover like titanium oxide are mixed; an embodiment (II) where (A) the high melt viscosity ionomer resin and the additives for the cover like titanium oxide are mixed, and then the obtained mixture and (B) the low melt viscosity ionomer resin are mixed; and an embodiment (III) where (A) the high melt viscosity ionomer resin, (B) the low melt viscosity ionomer resin and the additives for the cover like titanium oxide are mixed at the same time.

The method for mixing (A) the high melt viscosity ionomer resin and (B) the low melt viscosity resin, and the additives for the cover like titanium oxide is not limited, and they are melt mixed, for example, at the temperature of 150° C. to 230° C. with an extruder.

An embodiment for molding a cover is not particularly limited, and includes an embodiment which comprises injection molding the cover composition directly onto the core, or an embodiment which comprises molding the cover composition into a hollow-shell, covering the core with a plurality of the hollow-shells and subjecting the core with a plurality of the hollow shells to the compression-molding (preferably an embodiment which comprises molding the cover composition into a half hollow-shell, covering the core with the two half hollow-shells, and subjecting the core with the two half hollow-shells to the compression-molding).

In the case of directly injection molding the cover composition onto the core, it is preferred to use upper and lower molds for forming a cover having a spherical cavity and pimples, wherein a part of the pimple also serves as a retractable hold pin. When forming the cover by injection molding, the hold pin is protruded to hold the core, and the cover composition which has been heated and melted is charged and then cooled to obtain a cover. For example, the cover composition heated and melted at the temperature of 150° C. to 230° C. is charged into a mold held under the pressure of 980 KPa to 1,500 KPa for 0.1 to 1 second. After cooling for 15 to 60 seconds, the mold is opened and the golf ball with the cover molded is taken out from the mold.

When molding the cover in a compression molding method, molding of the half shell can be performed by either compression molding method or injection molding method, and the compression molding method is preferred. The compression-molding of the cover composition into half shell can be carried out, for example, under a pressure of 1 MPa or more and 20 MPa or less at a temperature of −20° C. or more and 70° C. or less relative to the flow beginning temperature of the cover composition. By performing the molding under the above conditions, a half shell having a uniform thickness can be formed. Examples of a method for molding the cover using half shells include compression molding by covering the core with two half shells. The compression molding of half shells into the cover can be carried out, for example, under a pressure of 0.5 MPa or more and 25 MPa or less at a temperature of −20° C. or more and 70° C. or less relative to the flow beginning temperature of the cover composition. By performing the molding under the above conditions, a cover for a golf ball having a uniform thickness can be formed.

The molding temperature means the highest temperature where the temperature at the surface of the concave portion of the lower mold reaches from closing through opening the molds. Further, the flow beginning temperature of the cover material can be measured in a pellet form under the following conditions by using a flow characteristics evaluation apparatus (Flow Tester CFT-500D, manufactured by Shimadzu Corporation).

Measuring conditions: Area size of a plunger: 1 $cm^2$, Die length: 1 mm, Die diameter: 1 mm, Load: 588.399 N, Start temperature: 30° C., and Temperature increase rate: 3° C./min.

After the cover is molded, the mold is opened and the golf ball body is taken out from the mold, and as necessary, the golf ball body is preferably subjected to surface treatments such as deburring, cleaning, and sandblast.

The method of preparing the golf ball of the present invention may further comprise a step of preparing (A) the high melt viscosity ionomer resin.

(A) The high melt viscosity ionomer resin can be prepared from (a-1) a resin consisting of the binary copolymer composed of ethylene and α,β-unsaturated carboxylic acid having 3 to 8 carbon atoms, or the ternary copolymer composed of ethylene, α,β-unsaturated carboxylic acid having 3 to 8 carbon atoms, α,β-unsaturated carboxylic acid ester (hereinafter, may be referred to as "(a-1) resin"); or (a-2) an ionomer resin consisting of one prepared by neutralizing at least a part of carboxyl groups of the binary copolymer composed of ethylene and α,β-unsaturated carboxylic acid having 3 to 8 carbon atoms with a metal ion, or one prepared by neutralizing at least a part of carboxyl groups of the ternary copolymer composed of ethylene, α,β-unsaturated carboxylic acid having 3 to 8 carbon atoms, α,β-unsaturated carboxylic acid ester with a metal ion (hereinafter, may be referred to as "(a-2) ionomer resin"; and (M) a metal ion source for neutralizing unneutralized carboxyl groups of the (a-1) resin and (a-2) ionomer resin.

Specific examples of the (a-1) resin includes an ethylene-methacrylic acid copolymer having a commercial name of "NUCREL (registered trademark) (e.g. NUCREL N1050H, NUCREL N2050H, NUCREL N1110H, NUCREL NO200H) available from Du Pont-Mitsui Polychemicals Co., Ltd.

Specific examples of the (a-2) ionomer resin include trade name "Himilan (registered trademark) (e.g. Himilan 1555 (Na), Himilan 1605 (Na), Himilan 1706 (Zn), Himilan 1707 (Na), Himilan AM7311 (Mg), Himilan AM7329 (Zn), Himilan 1856 (Na), Himilan 1855 (Zn), and the like)" commercially available from Du Pont-Mitsui Polychemicals Co., Ltd.

Further, ionomer resins commercially available from E.I. du Pont de Nemours and Company include trade name "Surlyn (registered trademark) (e.g. Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), Surlyn AD8546 (Li); Surlyn 6320 (Mg), Surlyn 8120 (Na), Surlyn 8320 (Na), Surlyn 9320 (Zn), Surlyn 9320W (Zn) as a ternary copolymerized ionomer; and the like)", "HPF 1000 (Mg), HPF 2000 (Mg)", and the like.

Further, ionomer resins commercially available from ExxonMobil Chemical Corporation include trade name "Iotek (registered trademark) (e.g. Iotek 8000 (Na), Iotek 8030 (Na), Iotek 7010 (Zn), Iotek 7030 (Zn), and the like)". Examples of a ternary copolymerized ionomer are "Iotek 7510 (Zn), Iotek 7520 (Zn)" and the like.

It is noted that Na, Zn, Li, and Mg described in the parentheses after the trade names indicate metal types of neutralizing metal ions for the metal neutralized copolymer.

(M) The metal ion source is not limited, as long as it is a basic metal compound that can neutralize unneutralized carboxyl groups of the (a-1) resin or the (a-2) ionomer resin. Examples of (M) the metal ion source are metal hydroxides such as magnesium hydroxide, calcium hydroxide, sodium hydroxide, lithium hydroxide, potassium hydroxide, copper hydroxide and the like; metal oxides such as magnesium oxide, calcium oxide, zinc oxide, copper oxide and the like; and metal carbonates such as magnesium carbonate, calcium carbonate, sodium carbonate, lithium carbonate, potassium carbonate and the like, or zinc acetate. These (M) metal ion sources are used solely or in combination of at least two of them.

Embodiments of preparing (A) the high melt viscosity ionomer resin include an embodiment (i) where the (a-1) resin and the (M) metal ion source having at least two metal inns are mixed, thereby neutralizing unneutralized carboxyl groups of the (a-1) resin, an embodiment (ii) where the (a-2) ionomer resin and the (M) metal ion source that has a different metal from that of the (a-2) ionomer resin are mixed, thereby neutralizing unneutralized carboxyl groups of the (a-2) ionomer resin, and an embodiment (iii) where at least two (a-2) ionomer resins neutralized with different metal ions respectively are mixed.

In the above embodiment (i), as "(M) metal ion source having at least two metal ions," a basic metal compound having two or more metal ions can be used, or a basic metal compound having one metal ion can be used in combination of at least two of them.

In the above embodiments (i) and (ii), a method for mixing the (a-1) resin, the (a-2) ionomer resin and the (M) metal ion source is not limited, as long as the unneutralized carboxyl groups of the (a-1) resin or the (a-2) ionomer resin can be neutralized with the (M) metal ion source. For example, the (a-1) resin and the (a-2) ionomer resin and the (M) metal ion source are melt mixed at the temperature of 150° C. to 230° C. with an extruder. Further, in the embodiment (iii), the method of mixing the (a-2) the ionomer resins for example includes, without limitation, melt-mixing the (a-2) ionomer resins at the temperature of 150° C. to 230° C.

In the case that the method of the present invention comprises a step of preparing (A) the high melt viscosity ionomer resin, it is preferable to prepare the cover composition by melt mixing (B) the low melt viscosity ionomer resin with a melt of (A) the high melt viscosity ionomer resin neutralized with at least two metal ions, subsequent to the step of preparing (A) the high melt viscosity ionomer resin.

Herein, "to melt mix (B) the low melt viscosity ionomer resin with a melt of (A) the high melt viscosity ionomer resin neutralized with at least two metal ions, subsequent to the step of preparing (A) the high melt viscosity ionomer resin" comprises melt-mixing the (a-1) resin and the like, adding the (B) low melt viscosity ionomer resin directly to the obtained melt of (A) the high melt viscosity resin, without cooling the melt of (A) the high melt viscosity ionomer resin. That is, the step of preparing (A) the high melt viscosity ionomer resin and the step of preparing a cover composition by mixing (A) the obtained high melt viscosity ionomer resin with (B) the low melt viscosity ionomer resin are conducted in a series of operations.

The step of preparing (A) the high melt viscosity ionomer resin and the step of preparing the cover composition are conducted in a series of operations, for example, by feeding and mixing the (a-1) resin, (a-2) resin and/or the (M) metal ion source through the main feeder, adding (B) the low melt viscosity ionomer resin from the side feeder while preparing (A) the high melt viscosity ionomer resin, and mixing them. In this case, the mixing temperature is preferably set from 150° C. to 230° C. The additives for the cover like titanium oxide may be fed from either of the main feeder and the side feeder.

In the case that the golf ball of the present invention is a coated golf ball, there is a step for forming a paint film. The paint film is, for example, formed by applying a paint to the surface of the golf ball body and drying the paint.

The method of applying the paint is not specifically limited, and includes a conventional method well known for coating the two-component type paint comprising a base material and a curing agent, such as air gun spray coating, brush coating, electrostatic coating and the like. When the paint is applied by coating with an air spray gun, the paint may be prepared by mixing the base material and the curing agent bit by bit, or by feeding the base material and the curing agent with respective pumps and continuously mixing them in a constant ratio through the line mixer such as a static mixer located in the stream line just before the spray gun. Alternatively, the base material and the curing agent can be air-sprayed respectively with the spray gun having the device for controlling the mixing ratio thereof.

The method of drying a paint is not limited. The paint is, for example, dried in a oven.

EXAMPLES

Hereinafter, the present invention will be described in detail by way of example. The present invention is not limited to examples described below. Various changes and modifications can be made without departing from the spirit and scope of the present invention.

(1) Hardness of Core and Golf Ball (Shore D Hardness)

A type P1 auto loading durometer manufactured by Kobunshi Keiki Co., Ltd., provided with a Shore D type spring hardness tester prescribed in ASTM-D2240 was used to measure the surface hardness and the center hardness of the core and the golf ball. Shore D hardness measured at the surfaces of the core and the golf ball are defined as the surface hardness of the core, and the golf ball, respectively. The core was cut into two hemispheres to obtain a cut plane, and a Shore D hardness measured at the center of the cut plane was used as the center hardness of the center or the core.

(2) Compression Deformation Amount (mm)

A compression deformation amount of the golf ball or the core (a shrinking amount of the golf ball or the core in the compression direction thereof), when applying a load from 98 N as an initial load to 1275 N as a final load to the golf ball or the core, was measured.

(3) Melt Viscosity Measure by a Flow Tester

The melt viscosity of a pellet-form sample was measured with the following conditions by using a flow characteristics evaluation apparatus (Flow Tester CFT-500D, manufactured by Shimadzu Corporation).

Measuring Conditions

Die length: 1 mm

Die diameter: 1 mm

Load: 294 N

Temperature: 190° C.

(4) Melt Viscosity Measured by a Brookfield Viscometer

The melt viscosity of (B) the low melt viscosity ionomer resin heated at the temperature of 190° C. was measured by a brookfield viscometer (BL type viscometer available from Tokyo Keiki Inc.). Rotor No. 4 was used at a rotation speed of 6 rpm.

(5) Content of Neutralized Divalent Metal

The content of the neutralized divalent metal was determined using ICP atomic emission spectrometer (Hitachi, Ltd. "P-410"). Specifically, 100 mg of sample was taken from the cover, 6 ml of concentrated sulfuric acid was added to the sample, and the mixture was subjected to the extraction (acid decomposition) with a microwave decomposition equipment (Microstone, ETHOS). To the extracted solution, water was added to prepare 250 ml of measurement sample for ICP analysis. From the obtained results, the content of the neutralized divalent metal per 100 g of the resin component of the cover composition was calculated according to the following mathematical expression.

Divalent metal content (mole)=[mass (g) of the divalent metal per 100 g of the resin component contained in the cover composition]/[atomic weight (g/mole) of each divalent metal] [Mathematical Expression]

(6) Melt Flow Rate (MFR) (g/10 min)

The MFR was measured using a flow tester (Shimadzu flow tester CFT-100C manufactured by Shimadzu Corporation) in accordance with JIS K7210. The measurement was conducted under the conditions of the measurement temperature 190° C. and the load of 2.16 kg.

(7) Slab Hardness (Shore D Hardness)

Sheets with a thickness of about 2 mm were produced by injection molding the cover composition, and stored at 23° C. for two weeks. Three or more of these sheets were stacked on one another so as not to be affected by the measuring substrate on which the sheets were placed, and the stack was measured with a type P1 auto loading durometer manufactured by Kobunshi Keiki Co., Ltd., provided with a Shore D type spring hardness tester prescribed in ASTM-D2240.

(8) Bending Stiffness (MPa)

A sheet with a thickness of about 2 mm was produced by injection molding the cover composition, and stored at 23° C. for two weeks. The bending stiffness was measured according to JIS K7106. The measurement was conducted under the conditions of the temperature 23° C. and humidity 50RH %.

(9) Repulsive Resilience

A sheet with a thickness of about 2 mm was produced by a hot press molding from the cover composition. A circle-shaped test piece having a diameter of 28 mm was cut out of this sheet, and 6 pieces of the test piece were stacked to prepare a cylindrical test piece having a thickness of about 12 mm and a diameter of 28 mm. The cylindrical test piece was subjected to the Lupke type repulsive resilience test (testing temperature 23° C., humidity 50RH %). Preparation of the test piece and the testing method are based on JIS K6255.

(10) Adhesion of Paint Film (Durability of Paint Film)

Each painted golf ball was hit 100 times repeatedly with a driver attached to a swing robot manufactured by TRU-ETEMPER CO, at the head speed of 45 m/sec. The degree of the peeling off of the paint film was observed and evaluated based on the following criteria.

E (Excellent): The paint film did not peel off at all.

G (Good): The area where the paint film peeled off was less than 1 $mm^2$.

F (Fair): The area where the paint film peeled off was from 1 $mm^2$ to 4 $mm^2$.

P (Poor): The area where the paint film peeled off was more than 4 $mm^2$.

required to break the golf ball was counted. The results of the ten golf balls were averaged. The results were shown by the actual number of collision times. In the case that the golf ball was not broken even at the 50 times collision, "NB (not broken)" was shown.

[Production of Golf Balls]

(1) Production of Core

The core rubber compositions having the formulations shown in Table 1 were kneaded and heat-pressed in upper and lower molds, each having a hemispherical cavity, at 170° C. for 15 minutes to prepare spherical cores having a diameter of 41.2 mm. The amount of barium sulfate was adjusted appropriately to make a golf ball have a weight of 45.4 g.

TABLE 1

| | Core No. | A | B | C | D |
|---|---|---|---|---|---|
| Formulation | Polybutadiene | 100 | 100 | 100 | 100 |
| | Zinc acrylate | 34 | 34 | 34 | 34 |
| | Zinc oxide | 5 | 5 | 5 | 5 |
| | Diphenyl disulfide | 0.5 | 0.5 | 0.5 | 0.5 |
| | Dicumyl peroxide | 0.8 | 0.8 | 0.8 | 0.8 |
| | Barium sulfate | Appropriate Amount*) | Appropriate Amount*) | Appropriate Amount*) | Appropriate Amount*) |
| Properties | Diameter (mm) | 41.2 | 38.2 | 40.4 | 41.8 |
| | Compression deformation amount (mm) | 3.2 | 3.2 | 3.2 | 3.2 |
| | Center hardness (Shore D) | 40 | 40 | 40 | 40 |
| | Surface hardness (Shore D) | 53 | 53 | 53 | 53 |

Formulation: parts by mass

*)Depending on the cover composition, adjustment was made such that the golf ball had a mass of 45.4 g.

Polybutadiene rubber: "BR-730 (high-cis polybutadiene)" manufactured by JSR Corporation.

Zinc acrylate: "ZNDA-90S" manufactured by Nihon Jyoryu Kogyo Co., Ltd.

Zinc oxide: "Ginrei R" manufactured by Toho Zinc Co., Ltd.

Barium sulfate: "Barium Sulfate BD" manufactured by Sakai Chemical Industry Co., Ltd.

Diphenyl disulfide: manufactured by Sumitomo Seika Chemicals Co., Ltd.

Dicumyl peroxide: "Percumyl (registered trademark) D" manufactured by NOF Corporation.

(11) Coefficient of Repulsion

A 198.4 g of metal cylindrical object was forced to collide with each golf ball at a speed of 40 m/sec, and the speeds of the cylindrical object and the golf ball before and after the collision were measured. Based on these speeds and the mass of each object, the coefficient of repulsion for each golf ball was calculated. The measurement was conducted by using twelve of each golf ball, and the average value was regarded as the coefficient of repulsion for the golf ball. The coefficient of repulsion of golf ball No. 1 was defined as an index of 100, and the coefficient of repulsion of each golf ball was represented by converting the coefficient of repulsion of each golf ball into this index.

(12) Durability

A metal-headed W#1 driver was installed on a swing robot M/C manufactured by Golf Laboratories, Inc. Each golf ball was hit at a head speed of 45 m/sec. This procedure was repeated, and the number of hits required to break the golf ball was counted. The number of hits for golf ball No. 6 was defined as an index of 100, and the durability of each golf ball was represented by converting the number of hits for each golf ball into this index. A greater index value indicates that the durability of the golf ball is excellent.

(13) Low Temperature Durability

Ten golf balls for each golf ball were made to collide with a metal board with an air gun at the speed of 45 m/sec., immediately after stored at the temperature of −10° C. for 1 day. This procedure was repeated, and the number of hits (2) Preparation of Cover Composition Blending materials shown in Tables 2 to 4 were mixed with a twin-screw kneading extruder provided with a side feeder to prepare a cover composition in the pellet form. The (a-2) resin and the (M) metal ion source were charged from the main feeder and mixed to prepare the (A) high melt viscosity ionomer resin, and the (B) low melt viscosity ionomer resin was added from the side feeder and mixed with the (A) high melt viscosity ionomer resin. The extruding conditions were a screw diameter of 45 mm, a screw rotational speed of 200 rpm, and screw L/D=35, and the mixtures were heated to 150 to 230° C. at the die position of the extruder.

(3) Production of Golf Ball Body

Golf balls were produced by injection-molding the cover composition onto the spherical core to form a cover. Upper and lower molds have a spherical cavity with pimples, a part of which serves as a hold pin which is extendable and retractable. The hold pins were protruded to hold the core, the resin heated to 210° C. was charged into the mold under a pressure of 80 tons within 0.3 seconds, and cooled for 30 seconds. Then, the mold was opened, and the golf ball body were taken out from the mold. The surface of the obtained golf ball body were treated with sandblast, marked, and painted with a clear paint. The paint was dried in an oven at 40° C. to form a paint film having a thickness of 10 μm, and golf balls having a diameter of 42.8 mm and a mass of 45.4 g were obtained. The evaluation results of the obtained golf ball are shown in Tables 2 to 4.

[Preparation of Clear Paint]

(i) Base material: urethane polyol 60 parts by mass of PTMG250 (BASF Co., polyoxytetramethyleneglycol having a molecular weight of 250), 54 parts by mass of 550 U (Sumitomo-Bayer Urethane Co., Ltd, branched polyol having a molecular weight of 550) were dissolved into 120 parts by mass of the solvent (toluene and methylethylketone). The dibutyl-tin-dilaurylate was added in an amount of 0.1 mass % with respect to the total base material. While keeping this polyol at the temperature of 80° C., 66 parts by mass of isophorone diisocyanate was slow-added into the polyol to obtain a urethane polyol having a solid content of 60 mass %, hydroxyl value of 75 mg KOH/g, and a weight average molecular weight of 7808.

(ii) Curing agent: Isophorone diisocyanate available from Sumitomo-Bayer Urethane Co., LTD.

(iii) Mixing ratio: NCO (curing agent)/OH (base material)=1.2 molar ratio.

TABLE 2

| | | Golf ball No. | 1 | 2 | 3 | 4 | 5 |
|---|---|---|---|---|---|---|---|
| Cover composition | Core No. | | A | A | A | B | C |
| | Resin component | (A) (a-2) Ionomer resin | 68.95 | 68.95 | 78.8 | 78.8 | 78.8 |
| | | (b) Magnesium hydroxide | 1.05 | — | — | — | — |
| | | Zinc oxide | — | 1.05 | 1.2 | 1.2 | 1.2 |
| | | Degree of Neutralization with monovalent metal ion (mole %) | 30 | 30 | 30 | 30 | 30 |
| | | Content ratio (molar ratio, M1/M2) of monovalent metal (M1) to divalent metal (M2) | 1.4 | 2.0 | 2.0 | 2.0 | 2.0 |
| | | Melt viscosity (Pa · s/190° C.) | 2,000 | 2,200 | 2,200 | 2,200 | 2,200 |
| | | (B) Aclyn201 (Ca) | 30 | — | — | — | — |
| | | Acyln295 (Zn) | — | 30 | 20 | 20 | 20 |
| | | (C) Nucrel 1050H | — | — | — | — | — |
| | | Fatty acid Behenic acid | — | — | — | — | — |
| | Titanium oxide | | 4 | 4 | 4 | 4 | 4 |
| | Material Properties | Divalent metal content (mole) per 100 g resin component | 0.039 | 0.024 | 0.022 | 0.022 | 0.022 |
| | | Melt flow rate (g/10 min) | 32 | 32 | 21 | 21 | 21 |
| | | Slab hardness (Shore D) | 59 | 59 | 61 | 61 | 61 |
| | | Bending stiffness (MPa) | 300 | 310 | 330 | 330 | 330 |
| | | Repulsive resilience (%) | 52 | 52 | 53 | 53 | 53 |
| Golf ball evaluation | | Cover thickness (mm) | 0.8 | 0.8 | 0.8 | 2.3 | 1.2 |
| | | Cover hardness (Shore D) | 62 | 62 | 65 | 65 | 65 |
| | | Compression deformation amount (mm) | 3.04 | 3.04 | 2.90 | 2.30 | 2.80 |
| | | Repulsion property (Index) | 100.1 | 100.2 | 100.4 | 100.7 | 100.5 |
| | | Paint adhesion | G | G | E | E | E |
| | | Durability (Index) | 125 | 120 | 125 | 200 | 150 |
| | | Low-temperature Durability (Times) | NB | NB | NB | NB | NB |

Formulation: parts by mass

TABLE 3

| | | Golf ball No. | 6 | 7 | 8 | 9 | 10 |
|---|---|---|---|---|---|---|---|
| Cover composition | Core No. | | D | A | A | A | A |
| | Resin component | (A) (a-2) Ionomer resin | 78.8 | 78.8 | 59.1 | 78.8 | 98.5 |
| | | (b) Magnesium hydroxide | — | — | — | — | 1.5 |
| | | Zinc oxide | 1.2 | 1.2 | 0.9 | 1.2 | — |
| | | Degree of Neutralization with monovalent metal ion (mole %) | 30 | 30 | 30 | 30 | 30 |
| | | Content ratio (molar ratio, M1/M2) of monovalent metal (M1) to divalent metal (M2) | 2.0 | 2.0 | 2.0 | 2.0 | 1.4 |
| | | Melt viscosity (Pa · s/190° C.) | 2,200 | 2,200 | 1,950 | 2,300 | 2,000 |
| | | (B) Aclyn201 (Ca) | — | 20 | 40 | — | — |
| | | Acyln295 (Zn) | 20 | — | — | 10 | — |
| | | (C) Nucrel 1050H | — | — | — | 10 | — |
| | | Fatty acid Behenic acid | — | — | — | — | — |
| | Titanium oxide | | 4 | 4 | 4 | 4 | 4 |
| | Material Properties | Divalent metal content (mole) per 100 g resin component | 0.022 | 0.029 | 0.039 | 0.018 | 0.026 |
| | | Melt flow rate (g/10 min) | 21 | 21 | 40 | 20 | 1.2 |
| | | Slab hardness (Shore D) | 61 | 61 | 57 | 60 | 63 |
| | | Bending stiffness (MPa) | 330 | 320 | 280 | 310 | 340 |
| | | Repulsive resilience (%) | 53 | 55 | 50 | 51 | 53 |
| Golf ball evaluation | | Cover thickness (mm) | 0.5 | 0.8 | 0.8 | 0.8 | 0.8 |
| | | Cover hardness (Shore D) | 65 | 65 | 61 | 64 | NG*) |
| | | Compression deformation amount (mm) | 3.00 | 2.90 | 3.06 | 3.02 | |
| | | Repulsion property (Index) | 100.3 | 100.2 | 100.0 | 100.2 | |

TABLE 3-continued

| Golf ball No. | 6 | 7 | 8 | 9 | 10 |
|---|---|---|---|---|---|
| Paint adhesion | E | E | G | G | |
| Durability (Index) | 100 | 112 | 110 | 120 | |
| Low-temperature Durability (Times) | NB | NB | NB | NB | |

Formulation: parts by mass
NG: Impossible to mold

TABLE 4

| | | | | | Golf ball No. | 11 | 12 | 13 |
|---|---|---|---|---|---|---|---|---|
| Cover composition | Core No. | | | | | A | A | A |
| | Resin component | (A) | (a-2) | Ionomer resin | | 44.32 | 93.6 | 44.32 |
| | | | (b) | Magnesium hydroxide | | — | — | — |
| | | | | Zinc oxide | | 0.68 | 1.4 | 0.68 |
| | | Degree of Neutralization with monovalent metal ion (mole %) | | | | 30 | 30 | 30 |
| | | Content ratio (molar ratio, M1/M2) of monovalent metal (M1) to divalent metal (M2) | | | | 2.0 | 2.0 | 2.0 |
| | | Melt viscosity (Pa · s/190° C.) | | | | 2,200 | 2,200 | 2,200 |
| | | (B) | Aclyn201 (Ca) | | | — | — | — |
| | | | Acyln295 (Zn) | | | 55 | — | — |
| | | (C) | Nucrel 1050H | | | — | — | — |
| | | Fatty acid | Behenic acid | | | — | 5 | 55 |
| | Titanium oxide | | | | | 4 | 4 | 4 |
| | Material Properties | Divalent metal content (mole) per 100 g resin component | | | | 0.028 | 0.017 | 0.008 |
| | | Melt flow rate (g/10 min) | | | | 40 | 18 | 38 |
| | | Slab hardness (Shore D) | | | | 51 | 61 | 53 |
| | | Bending stiffness (MPa) | | | | 170 | 196 | 162 |
| | | Repulsive resilience (%) | | | | 43 | 52 | 43 |
| Golf ball evaluation | | Cover thickness (mm) | | | | 0.8 | 0.8 | 0.8 |
| | | Cover hardness (Shore D) | | | | 57 | 65 | 59 |
| | | Compression deformation amount (mm) | | | | 3.14 | 3.02 | 3.11 |
| | | Repulsion property (Index) | | | | 96.0 | 100.0 | 95.0 |
| | | Paint adhesion | | | | P | P | P |
| | | Durability (Index) | | | | 90 | 96 | 87 |
| | | Low-temperature Durability (Times) | | | | 15 | 6 | 2 |

Formulation: parts by mass

Notes on tables 2 to 4

Formulation: parts by mass

Ionomer resin: Sodium ion neutralized ethylene-methacrylic acid copolymer ionomer resin (Acid content: 15 mass %, Sodium ion neutralization degree: 30 mole %, melt viscosity (190° C.) measured by a flow tester: 2.8 Pa·s, melt flow rate (190° C.*2.16 kg): 10 g/10 min)

Magnesium hydroxide: Yoneyama Yakuhin Kogyo CO., LTD

Zinc oxide: Yoneyama Yakuhin Kogyo Co., LTD

Aclyn201: Calcium neutralized binary copolymer composed of ethylene and α,β-unsaturated carboxylic acid having 3 to 8 carbon atoms (Brookfield melt viscosity (190° C.): 5.5 Pa·s, melt flow rate (190° C.*2.16 kg): 185 g/10 min) available from Honeywell Aclyn295: Zinc neutralized binary copolymer composed of ethylene and α,β-unsaturated carboxylic acid having 3 to 8 carbon atoms (Brookfield melt viscosity (190° C.): 4.5 Pa·s, melt flow rate (190° C.*2.16 kg): 1,200 g/10 min) available from Honeywell Nucrel 1050H: ethylene-methacrylic acid copolymer (melt viscosity (190° C.) measured by a flow tester: 6 Pa·s, melt flow rate (190° C.*2.16 kg): 500 g/10 min) available from Du Pont-Mitsui Polychemicals Co., Ltd.

Behenic acid: "NAA-222S powder" available from NOF Corporation

As apparent from tables 2 to 4, the cover compositions No. 1 to No. 9 of the present invention showed a low melt flow rate and an excellent fluidity, in spite of showing the high repulsion. Further, during molding, bleed out of the low molecular weight material like the fatty acid was not observed and thus the obtained golf ball showed a good paint adhesion. Further, the cover compositions No. 1 to No. 9 of the present invention provided golf balls that are excellent in durability and low-temperature durability.

Golf ball No. 10 is the case that the cover composition does not contain a component corresponding to (B) the low melt viscosity ionomer resin. The cover composition showed a poor fluidity and thus it was impossible to mold the cover. Golf ball No. 11 is the case that the content of a component corresponding to (B) the low melt viscosity ionomer resin was too high. Durability was remarkably lowered. Golf balls No. 12 and 13 are the cases that the low molecular weight material like a fatty acid was used. Bleed out occurred on the surface of the golf ball body and the adhesion of the paint film was not good. Further, the low-temperature durability was remarkably lowered.

The present invention provides a golf ball excellent in the fluidity, adhesion of the paint film, and repulsion, and further provides a golf ball which is excellent in the durability and low-temperature durability.

This application is based on Japanese Patent applications No. 2008-237038 filed on Sep. 16, 2008, No. 2009-143623 filed on Jun. 16, 2009, and No. 2009-193331 filed on Aug. 24, 2009 the contents of which are hereby incorporated by reference.

The invention claimed is:

1. A golf ball comprising:

a core and a cover covering the core, wherein the cover is formed from a cover composition that contains as a resin component, (A) a high melt viscosity ionomer resin having a melt viscosity (190° C.) ranging from 500 Pa·s to 100,000 Pa·s measured by a flow tester and being neutralized with at least two kinds of metal ions, and (B) a low melt viscosity ionomer resin having a melt, viscosity (190° C.) ranging from 1 Pa·s to 10 Pa·s measured by a brookfield viscometer and a melt flow rate (190° C.*2.16 kg) ranging from 100 g/10 min to 2,000 g/10 min, in a ratio of (A) the high melt viscosity ionomer resin/(B) the low melt viscosity ionomer resin being 55 mass % to 99 mass %/45 mass % to 1 mass %, wherein the cover composition has a melt flow rate (190° C.*2.16 kg) ranging from 10 g/10 min to 100 g/10 min.

2. The golf hall according to claim 1, wherein the cover composition has a bending stiffness ranging from 100 MPa to 450 MPa.

3. The golf ball according to claim 1, wherein the cover composition has a repulsive resilience of 40% or more.

4. The golf ball according to claim 1, wherein the cover composition has a slab hardness from 40 to 70 in Shore D hardness.

5. The golf ball according to claim 1, wherein the cover composition further comprises (C) a nonionic thermoplastic resin having a melt viscosity (190° C.) ranging from 5 Pa·s to 3,000 Pa·s measured by a flow tester, and contains each component in the content of (A) the high melt viscosity ionomer resin: 50 mass % to 90 mass %, (B) the low melt viscosity ionomer resin: 5 mass % to 20 mass %, and (C) the nonionic thermoplastic resin: 5 mass % to 30 mass %.

6. A golf ball comprising:

a core and a cover covering the core, wherein the cover is formed from a cover composition that contains as a resin component, (A) a high melt viscosity ionomer resin having a melt viscosity (190° C.) ranging from 500 Pa·s to 100,000 Pa·s measured by a flow tester, being neutralized with at least two kinds of metal ions, and consisting of one prepared by neutralizing at least a part of carboxyl groups in a binary copolymer composed of ethylene and α,β-unsaturated carboxylic acid having 3 to 8 carbon atoms with at least two kinds of metal ions, one prepared by neutralizing at least a part of carboxyl groups in a ternary copolymer composed of ethylene and α,β-unsaturated carboxylic acid having 3 to 8 carbon atoms and α,β-unsaturated carboxylic acid ester with at least two kinds of metal ions, or a mixture of one prepared by neutralizing at least a part of carboxyl groups in a binary copolymer composed of ethylene and α,β-unsaturated carboxylic acid having 3 to 8 carbon atoms with a metal ion, and one prepared by neutralizing at least a part of carboxyl groups in a ternary copolymer composed of ethylene, α,β-unsaturated carboxylic acid having 3 to 8 carbon atoms and α,β-unsaturated carboxylic acid ester with a metal ion, wherein the mixture is neutralized with at least two kinds of metal ions, and (B) a low melt viscosity ionomer resin having a melt viscosity (190° C.) ranging from 1 Pa·s to 10 Pa·s measured by a brookfieid viscometer and a melt flow rate (190° C.*2.16 kg) ranging from 100 g/10 min to 2,000 g/10 min, and consisting of one prepared by neutralizing at least a part of carboxyl groups in a binary copolymer composed of ethylene and α,β-unsaturated carboxylic acid having 3 to 8 carbon atoms with a metal ion, one prepared by neutralizing at least a part of carboxyl groups in a ternary copolymer composed of ethylene, α,β-unsaturated carboxylic acid having 3 to 8 carbon atoms and α,β-unsaturated carboxylic acid ester with a metal ion, or a mixture thereof, in a ratio of (A) the high melt viscosity ionomer resin/(B) the low melt viscosity ionomer resin being 55 mass % to 99 mass %/45 mass % to 1 mass %, wherein the cover composition has a melt flow rate (190° C.*2.16 kg) ranging from 10 g/10 min to 100 g/10 min.

7. The golf ball according to claim 6, wherein (A) the high melt viscosity ionomer resin comprises:

a monovalent metal ion (M1) consisting of a sodium ion and/or a lithium ion, and a divalent metal ion (M2) consisting of a zinc ion and/or a magnesium ion, in a molar ratio (M1/M2) ranging from 0.1 to 60.

8. The golf ball according to claim 6, wherein (A) the high melt viscosity ionomer resin consists of one prepared by neutralizing at least a part of carboxyl groups in the binary copolymer composed of ethylene and α,β-unsaturated carboxylic acid having 3 to 8 carbon atoms with at least two kinds of metal ions, or one prepared by neutralizing at least a part of carboxyl groups in the ternary copolymer composed of ethylene, α,β-unsaturated carboxylic acid having 3 to 8 carbon atoms and α,β-unsaturated carboxylic acid ester with at least two kinds of metal ions.

9. The golf ball according to claim 6, wherein at least a part of carboxyl groups of (B) the low melt viscosity ionomer resin is neutralized with one metal ion selected from the group consisting of Na, Ca, Mg and Zn.

10. The golf hall according to claim 6, wherein (B) the low melt viscosity ionomer resin has a neutralization degree of the carboxyl groups from 10 mole % to 100 mole %.

11. The golf ball according to claim 6, wherein the cover composition comprises the divalent metal ion in an amount of at least 0.015 mol per 100 g of the resin component thereof.

12. The golf ball according to claim 6, wherein the cover composition further comprises (C) a nonionic thermoplastic resin having a melt viscosity (190° C.) ranging from 5 Pa·s to 3,000 Pa·s measured by a flow tester.

13. The golf hall according to claim 12, wherein (C) said nonionic thermoplastic resin comprises a binary copolymer composed of ethylene and the unsaturated carboxylic acid having 3 to 8 carbon atoms.

14. The golf ball according to claim 6, wherein the cover has a thickness ranging from 0.1 mm to 3 mm.

* * * * *